US006244505B1

(12) United States Patent
Grimes et al.

(10) Patent No.: US 6,244,505 B1
(45) Date of Patent: Jun. 12, 2001

(54) SECURITY MAILBOX ASSEMBLY

(76) Inventors: James W. Grimes; Rebecca Ann Grimes, both of 1349 Barclay Dr., Carrollton, TX (US) 75007

( * ) Notice: Subject to any disclaimer, the term of this patent is extended or adjusted under 35 U.S.C. 154(b) by 0 days.

(21) Appl. No.: 09/327,109

(22) Filed: Jun. 7, 1999

(51) Int. Cl.[7] ..... B65G 11/04

(52) U.S. Cl. ..... 232/47; 232/17; 232/43.1

(58) Field of Search ..... 232/17, 43.1, 39, 232/33, 45, 47, 38; D99/29–31

(56) References Cited

U.S. PATENT DOCUMENTS

| | | | | |
|---|---|---|---|---|
| D. 337,415 | * | 7/1993 | McDowell | D99/29 |
| 2,068,275 | * | 1/1937 | Luss | 232/33 |
| 3,735,919 | | 5/1973 | Morgan . | |
| 3,758,027 | | 9/1973 | Morgan . | |
| 3,874,583 | | 4/1975 | Moll . | |
| 3,880,344 | | 4/1975 | Earle . | |
| 4,382,540 | | 5/1983 | Kelly et al. . | |
| 4,724,999 | | 2/1988 | Fitzgerald . | |
| 4,793,551 | | 12/1988 | Baylor . | |
| 4,844,332 | | 7/1989 | Long . | |
| 4,875,622 | * | 10/1989 | Lents | 232/39 |
| 4,905,891 | | 3/1990 | Wildish et al. . | |
| 4,993,626 | | 2/1991 | Berry . | |
| 5,000,378 | | 3/1991 | Dorr et al. . | |
| 5,071,063 | | 12/1991 | Overstreet . | |
| 5,096,115 | | 3/1992 | Hassan . | |
| 5,143,284 | | 9/1992 | Socarras . | |
| 5,148,974 | | 9/1992 | Clapper . | |
| 5,351,883 | | 10/1994 | Pachl . | |
| 5,361,977 | | 11/1994 | Ogrodnick, Jr. . | |
| 5,407,126 | | 4/1995 | Coultas et al. . | |
| 5,407,127 | * | 4/1995 | Worden | 232/17 |
| 5,435,484 | | 7/1995 | Carlson . | |
| 5,526,979 | * | 6/1996 | Mann | 232/47 X |
| 5,617,993 | | 4/1997 | Morris . | |
| 5,833,132 | * | 11/1998 | Bachmeier | 232/43.1 X |
| 5,938,113 | * | 8/1999 | Kim | 232/43.1 X |

* cited by examiner

*Primary Examiner*—Lynne H. Browne
*Assistant Examiner*—William L. Miller
(74) *Attorney, Agent, or Firm*—Dennis T. Griggs

(57) ABSTRACT

A security mailbox assembly includes a mail storage module enclosing a mail storage vault and a mail drop port. A mailbox is mounted on the mail storage module directly over the mail drop port. The mailbox includes a pivot door that is movable to an open position for presenting outgoing mail and for receiving incoming mail. The pivot door includes a trap door panel covering the mail drop port when the pivot door is in the open position, with the trap door panel being rotatable through the mail drop port and into the security vault as the pivot door is moved to the closed position. A mail tray is attached to the pivot door for holding outgoing mail, and a rotatable disc flag is coupled to the mailbox.

10 Claims, 4 Drawing Sheets

SECURITY MAILBOX ASSEMBLY

CROSS-REFERENCE TO RELATED APPLICATIONS

This application is related to the following application:

U.S. application. Ser. No. 29/091,703, filed Aug. 4, 1998 now U.S. Pat No. Des. 410,849.

STATEMENT REGARDING FEDERALLY SPONSORED RESEARCH OR DEVELOPMENT

Not applicable

BACKGROUND OF THE INVENTION

The invention relates generally to mail receptacles and more particularly to a security mailbox assembly.

Curb-side residential mailboxes are commonly used as a convenient location for the postal carrier to deliver mail, including letters and small packages. They also allow a convenient location for outgoing mail to be left for the postal carrier to collect. Mailboxes should keep the mail dry, be easily accessed and should readily identify the street address. While conventional designs have accomplished these functions, there is a continuing interest in improving the security, construction and aesthetics of residential mailboxes.

Because private messages and valuables are delivered by postal carriers, it is, of course, desirable to prevent theft. Recent mailbox designs have focused on security. For example, U.S. Pat. No. 5,071,063, entitled "Security Mail Receptacle" shows a mailbox mounted on a tubular support column that allows the mail to fall into a bottom pocket where it may be removed by the resident through a rear locking door. A similar design is shown in U.S. Pat. No. 4,793,551, entitled "Storage Mail Box." In addition to security concerns, some residential mailboxes need to accommodate larger quantities of mail to allow mail to be stored during extended absences. Accomplishing all the desired functions for a mailbox while making it aesthetically pleasing and cost-effective to manufacture, remains a challenge.

BRIEF SUMMARY OF THE INVENTION

A mailbox assembly for receiving and securely holding incoming mail while allowing outgoing mail to be readily removed includes a mail storage module including sidewalls enclosing an internal mail storage vault and a mail drop port formed therein. A mailbox receptacle is mounted on the mail storage module and overlies the mail drop port. The mailbox receptacle includes a pivot door that is movable to an open position for presenting outgoing mail and for receiving incoming mail, and the pivot door includes a trap door panel covering the mail drop port when the pivot door is in the open position. The trap door panel is rotatable through the mail drop port and into the security vault as the pivot door is moved to the closed position. The mail storage module includes a collection panel for receiving deposited mail and an angled guide panel for directing deposited mail toward the collection panel. A metal panel forms at least a portion of one module sidewall below the mailbox, the metal panel being sized and configured to allow the trap door panel of the pivot door to hang substantially in flush engagement with the metal panel when the pivot door is in the closed position. A locking access door provides authorized access to the mail storage vault.

According to other features of the present invention, the mailbox receptacle includes an outgoing mail tray mounted on the pivot door and a rotatable disc flag. According to another aspect, the metal panel that forms at least part of one sidewall of the mail storage module also forms a portion of the exterior wall of the enclosure unit for displaying street address information.

BRIEF DESCRIPTION OF THE DRAWING

The accompanying drawing is incorporated into and forms a part of the specification to illustrate the preferred embodiments of the present invention. Various advantages and features of the invention will be understood from the following detailed description taken in connection with the appended claims and with reference to the attached drawing figures in which:

DETAILED DESCRIPTION OF THE INVENTION

Figure 2:
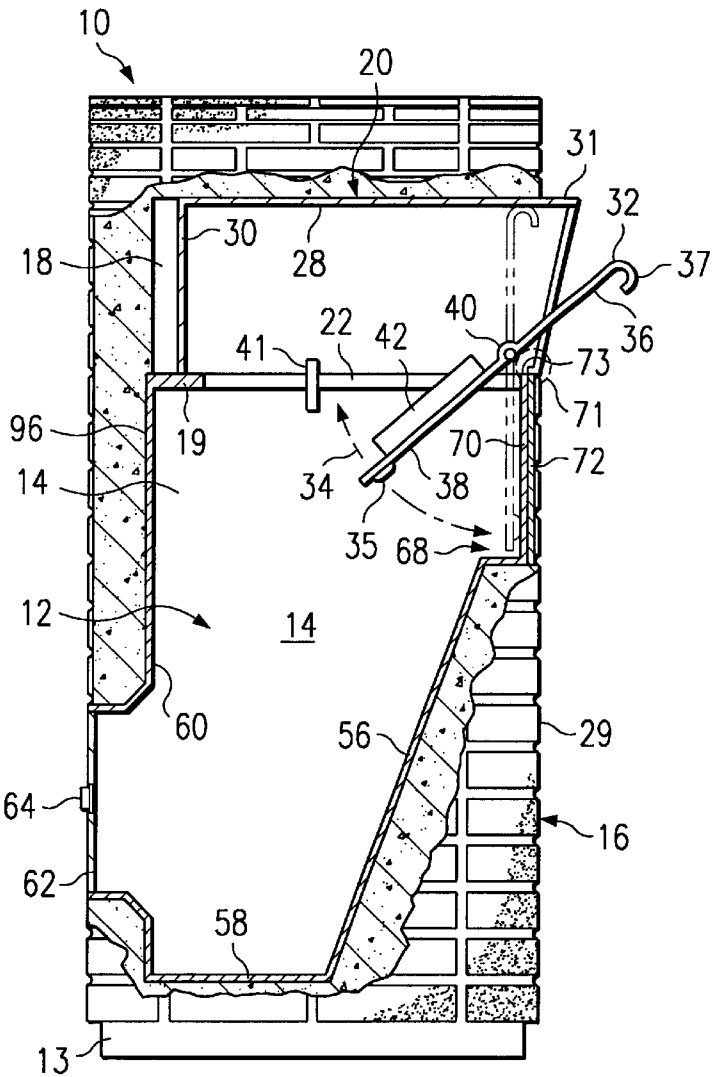
FIG. 2 is a left side elevational view of the mailbox assembly of FIG. 1, partially in section, showing the pivot door in a partly open position.

Preferred embodiments of the invention will now be described with reference to various examples of how the invention can best be made and used. Like reference numerals are used throughout the description and several views of the drawing to indicate like or corresponding parts.

Referring to FIGS. 1–6 and FIGS. 9–13, a mailbox assembly 10 according to the preferred embodiment of the present invention is illustrated. The mailbox assembly 10 includes an internal mail storage module 12 supported on a concrete foundation pad or slab 13. A mail storage vault 14, which is shown in FIG. 2, is enclosed within and protected by the module 12. The mail storage module 12 may be constructed in various shapes and sizes and from various types of material, but is preferably of all-metal welded construction as shown in FIGS. 9–13. The mail storage module 12 is preferably enclosed within and supported in an upright service position by an external shell 16 of masonry construction (e.g., bricks, stucco, concrete, etc.).

Figure 1:
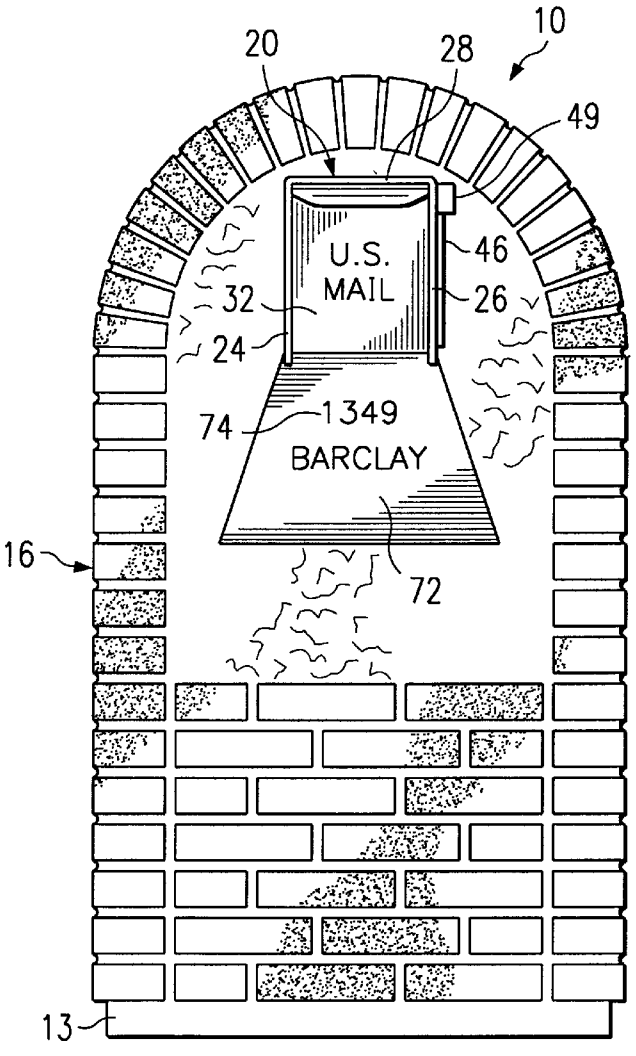
FIG. 1 is front elevational view of the security mailbox assembly of the present invention.
Figure 7:
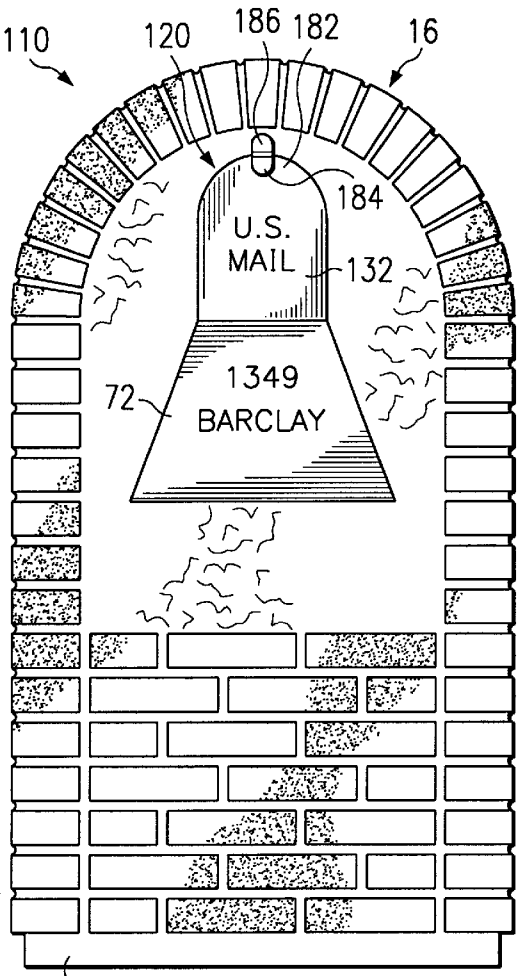
FIG. 7 is a front elevational view, similar to FIG. 1, showing an alternative embodiment of the security mailbox assembly of the present invention.
Figure 6:
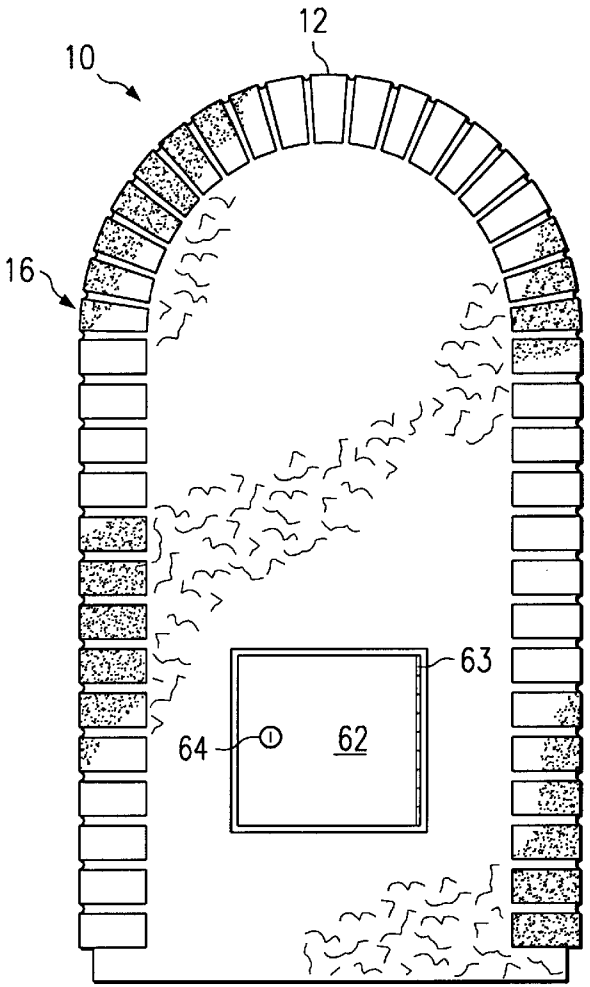
FIG. 6 is a rear elevational view of the security mailbox assembly of FIG. 1.

As shown in FIGS. 1 and 6, the masonry shell 16 is formed in an arched style that enhances the aesthetics of the mailbox assembly 10. A rectangular style may also be used. As shown in FIG. 2, the masonry shell 16 arches over the top of the mail storage module 12, thus providing a compartment or pocket 18 for receiving a mailbox receptacle 20. The mailbox receptacle 20 is installed within the pocket 18 and is attached to a top panel 19 of the mail storage module 12 by a clamp bracket or sheet metal fastener. In the preferred embodiment, the mailbox receptacle 20 has a rectangular frame formed by flat side walls 24 and 26, a flat top wall 28 and a flat back wall 30(see FIG. 4). Optionally, the mailbox receptacle frame may have other conventional profiles, such as an arched top 180 with flat side walls as shown in FIG. 7.

Figure 9:
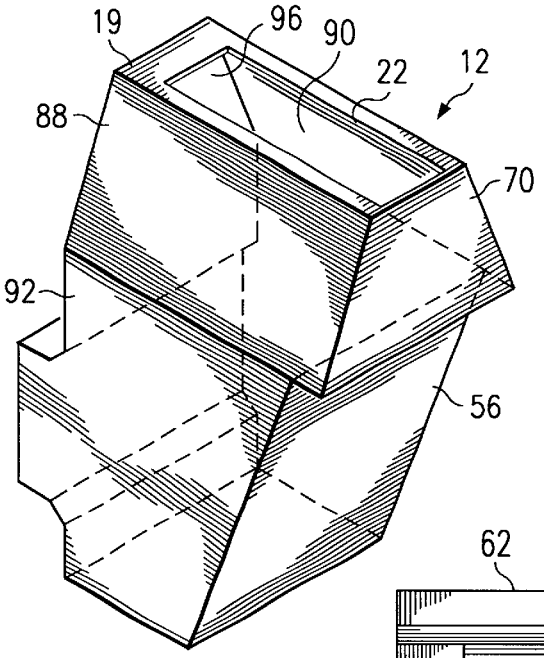
FIG. 9 is a perspective view of a mail storage module having all-metal welded construction.
Figure 11:
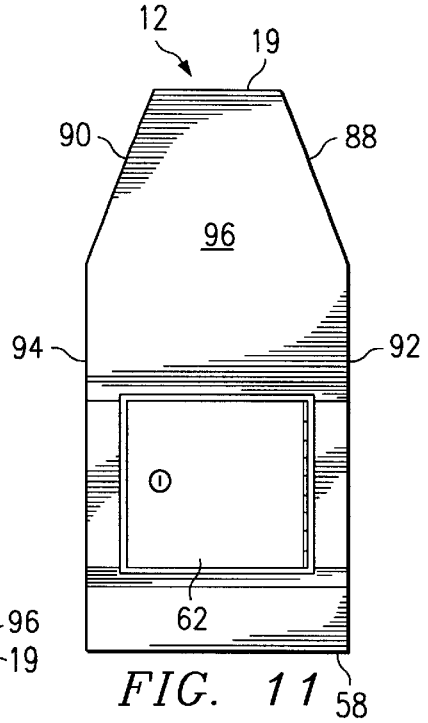
FIG. 11 is a rear elevational view thereof.
Figure 10:
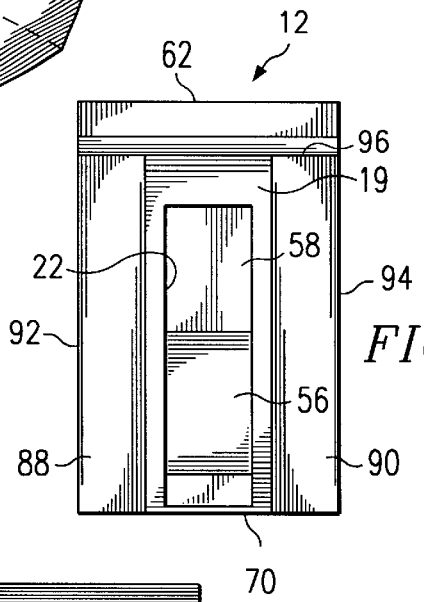
FIG. 10 is a top plan view thereof.
Figure 12:
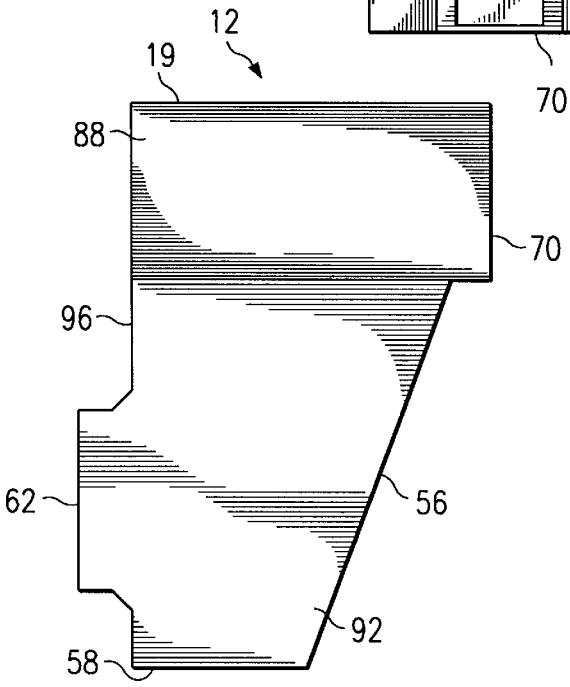
FIG. 12 is a left side elevational view thereof, the right side elevational view being the mirror image thereof; and, FIG. 13 is a front elevational view thereof.
Figure 13:
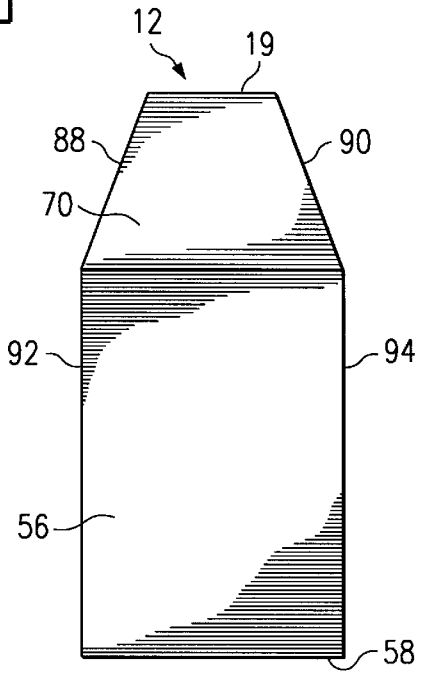

The mailbox receptacle 20 is unlike conventional mailboxes in that it does not include a fixed bottom panel. Instead, the mailbox receptacle is provided with a large bottom opening 21 and a door. As shown in FIG. 9 and FIG. 10, the top panel 19 of the module 12 is intersected by a large rectangular cut-out opening 22 that functions as a mail drop port. The sidewalls 24, 26 and 28 of the mailbox receptacle bridge over the drop port 22, with the bottom opening 21 of the mailbox receptacle being aligned with the drop port 22.

The top wall 28 of the mailbox receptacle 20 projects beyond the exterior surface of the forward wall 29 of the masonry shell 16 (see FIG. 2). The portion of the top wall 28 extending beyond the exterior surface of the masonry shell is referred to as an extension overhang portion 31. The overhang portion 31 helps to prevent rain and dust from entering the mailbox receptacle 20 and mail storage vault 14.

A pivot door 32 is pivotally coupled to the mailbox receptacle side walls 24 and 26. The pivot door 32 is rotatable through the drop port 22 between an open position and a closed position as shown by the movement arrow 34 in FIG. 2. The pivot door 32 includes a top panel portion 36 and a trap door panel 38. The pivot door 32 is centered with the drop port so that the trap door panel 38 can rotate freely between the closed and open positions. The top panel portion 36 has a handle 37 for opening the door 32 and is preferably curved to assist in water-proofing the mailbox assembly 10. The trap door panel 38 receives incoming mail when the pivot door is open, and guides deposited mail through the drop port 22 into the storage vault 14 when the pivot door is closed.

The pivot door 32 is coupled to the mailbox receptacle 20 by a hinge 40 that is located between the top panel portion 36 and the lower trap door panel 38. The trap door panel 38 is preferably heavier than the top panel portion 36. This counterweight arrangement assists in keeping the pivot door 32 closed. The door 32 may, however, be held in the open position temporarily by a latch, such as a friction strip 41, that is mounted on the top panel 19. The distance between the mail storage module drop port 22 and the bottom of the storage vault is long enough to prevent an unauthorized person from reaching around the pivot door 32 in the open position, thereby denying unauthorized access to mail collected in the storage vault 14.

Figure 3:
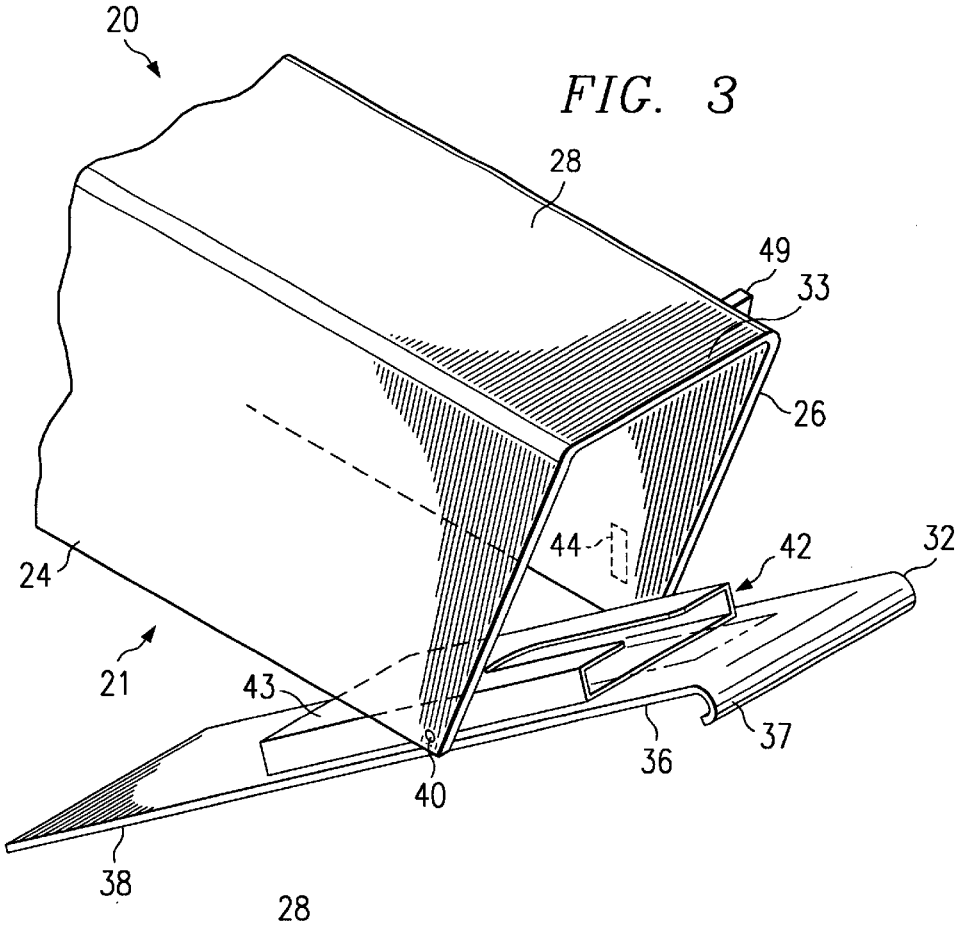
FIG. 3 is a perspective view, partially broken away, of the mailbox shown in FIG. 1.

Referring now to FIG. 3, a cassette or mail retainer tray 42 for holding outgoing mail is attached to the pivot door 32. The mail tray 42 is preferably made of plastic, but can be constructed of a metal such as aluminum or wood materials as well. Labels with instructions for the postal carrier that the tray 42 should be used only for outgoing mail may be added for clarity on an interior portion of door 32 that is visible when the door 32 in the open position. In addition or as an alternative, a spring-loaded clip 44 is attached to the interior side of the mailbox wall 26, and is used to hold outgoing mail. The clip 44 (or multiple clips) may be provided to hold larger pieces of mail.

A signal flag, such as a red rotatable flag 46, is attached to the mailbox receptacle 20 to alert the postal carrier to stop for outgoing mail. The signal flag 46 is rotatably attached to the sidewall 26 of the mailbox receptacle 20 and uses a hinge 40 as its rotatable connection. The flag 46 is preferably in the form of a quadrant disc and has an extended pull down arm 48, which includes a tab 49.

Figure 4:
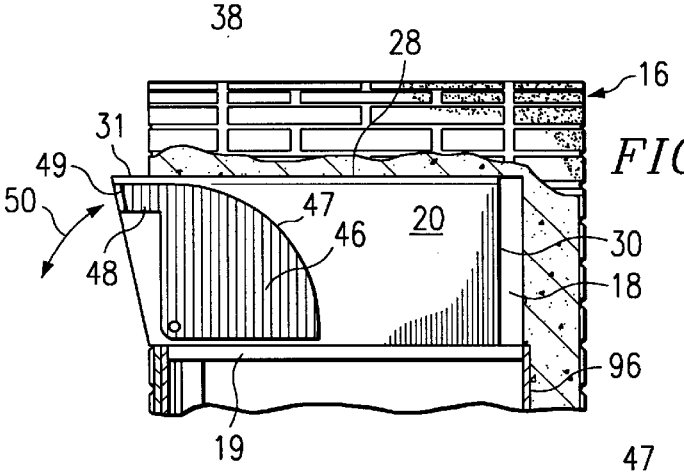
FIG. 4 is a right side elevational view of a portion of the mailbox assembly of FIGS. 1 and 2, partially broken away and partially in section, showing the flag in the fully retracted position.
Figure 5:
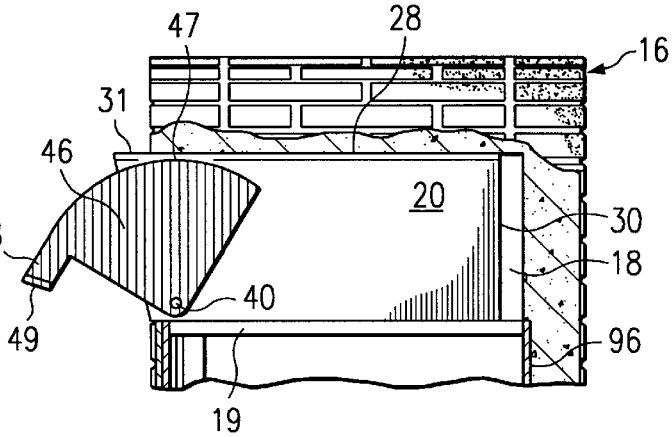
FIG. 5 is a view similar to FIG. 4, showing the flag in the fully extended position.

The signal flag 46 is rotatable between a no outgoing-mail position (FIG. 4) and an outgoing-mail position, or extended signaling position as suggested by arrow 50 in FIG. 4 and shown in FIG. 5. In the FIG. 4 embodiment, the flag 46 is mounted outside of the mailbox receptacle and is held in the outgoing-mail position by the upper radius curvature of the quadrant disc wedging against an upper surface of the masonry shell 16. Optionally, the flag 46 is mounted inside of the mailbox 20 and the curved portion 47 of the quadrant flag 46 is wedged against the top panel 28 of the mailbox unit. Because the most vertical portion of the signal flag 46 does not extend above the top of mailbox wall 28, and because of the quadrant profile of the flag, the masonry shell 16 can be sealed against the mailbox side walls.

As shown in FIG. 2, the mail storage vault 14 lies directly below the drop port 22. The vault 14 is preferably sized to hold numerous pieces of mail that could accumulate over an extended period of absence. The mail storage module 12 includes an angled guide panel 56 that directs received mail toward a collection plate or bottom panel 58. The guide panel 56 and collection plate 58 are preferably constructed of sheet metal, but these and the other module walls may be constructed of durable plastic, or wood materials. The guide panel 56 should have an angle that, considering its coefficient of friction, allows mail to readily slide onto the collection plate 58.

A rear sidewall portion 60 opposite to the guide panel 56 includes a recessed, locking access door 62. As shown in FIG. 6, the access door 62 pivots on a hinge 63 and includes a lock 64 to securely hold it closed. The lock 64 may be unlocked and the door 62 opened by authorized persons to retrieve mail that has been deposited into the vault 14.

Figure 8:
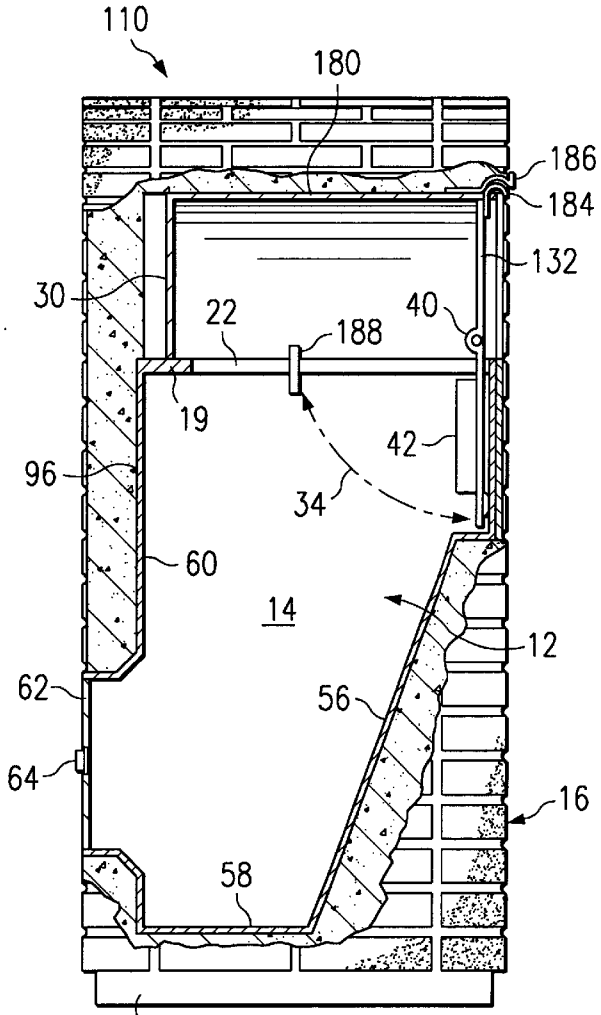
FIG. 8 is a left side elevational view of the embodiment of FIG. 7, partially in section, showing the pivot door in a closed position.

An upper compartment or pocket 68 formed in the storage module 12 is configured to receive the trap door panel 38 of the pivot door 32 when it is in the closed position. The pocket 68 allows the pivot door 32 to hang vertically substantially parallel to and at least nearly flush against an upper panel 70. That is, the trap door panel 38 of the pivot door 32 is substantially flush with an interior surface of the upper panel 70 when the pivot door 32 is in the closed position (FIG. 8). A soft bumper 35 is attached to door 32 to cushion its impact against the upper panel 70.

A metal display plate 72 is attached to and overlays the upper panel 70 adjacent and immediately below the pivot door 32. The metal display plate 72 may be inscribed with alpha numeric visual indicia 74 such as the resident's name and address. The metal display plate 72 is preferably made of brass, copper or bronze to provide a custom finished appearance on the outside of mailbox assembly 10. In the preferred embodiment, the display plate 72 and upper wall panel 70 are integrally formed as a single unit.

Depending on where the hinge 40 is placed, there may be a small gap or area 71 between the panel 70 and the pivot door 32 where leakage problems might occur. As shown in FIG. 2, one way to prevent or avoid a leakage problem is to place a seal barrier strip such as a tubular gasket 71, which is preferably a flexible rubber material, along a top edge 73 of the panel 70.

In operation, the resident with outgoing mail pulls on the handle 37 and rotates the pivot door 32 to an open position. Outgoing mail is then placed in the tray 42 and the pivot door 32 is closed. Optionally, the outgoing mail may be placed in the spring-loaded clip 44. The resident will then rotate the signal flag 46 to the extended signaling position by pulling outwardly on the extension tab 49.

The postal carrier will open the receptacle door 32 by pulling on the handle 37 and removes the outgoing mail from the mail tray 42 (or clip 44) and then rotates the signal flag 46 to the retracted position. The postal carrier then places incoming mail on the lower trap door panel 38 of the pivot door 32 and on top of the tray 42. The incoming mail rests on the trap door panel 38 until the pivot door 32 is closed. As discussed above, the pivot door 32 is urged to the closed position by the counter-weight action of the trap door panel. Optionally, the pivot door may be selectively held open by wedge engagement against the friction strip 41. As the door 32 is closed, the incoming mail falls through the drop port 22 and slides along the guide panel 56 which directs the incoming mail onto the collection panel 58. The resident may then retrieve the collected mail by unlocking the lock 64 and opening the access door 62.

Referring to FIGS. 9–13, the mail storage module 12 is a welded assembly of flat sheet-metal panels, including the previously described top panel 19, the sloping guide panel 56, the collection panel 58 and the forward display panel 70. The sheet metal panels are preferably made of stainless steel. These panels are joined by edge welds to sloping side panels 88, 90; main vault side panels 92, 94 and a back panel 96. This welded combination of panels provides a structurally stable module and a secure enclosure for the mail storage vault 14. Access to the mail storage vault is provided only through the drop port 22 or through the locked rear access door 62.

The mailbox receptacle 28 is fabricated separately, and is mounted on the top panel 19 of the module 12 by welding or by sheet metal fasteners. According to this arrangement, the mail storage module with attached mailbox receptacle can be delivered for immediate on-site installation on the concrete pad 13, and the masonry shell 16 can then be constructed around the assembly. Alternatively, the mailbox receptacle 28 can be attached to the module 12 at the time of installation and prior to completion of the masonry finish work.

Referring now to FIGS. 7 and 8, an alternative embodiment of a mailbox assembly 110 is presented. With the exception of the differences noted below, the alternative embodiment is substantially identical to the preferred embodiment of FIGS. 1–6. The mailbox assembly 110 includes a mailbox 120 that has an arched top wall 180. Further, the pivot door 132 has an arched upper portion 182. The upper portion 182 includes a pull tab 184 for pulling the door 132 open, and also for mating with a similarly-shaped latch tab 186 that holds the door 32 closed and provides a water tight seal. Thus, in this embodiment, an overhang (e.g., overhang portion 31 of FIG. 2) is not provided. The door 132 may be held in the open position (suggested by arrow 34 of FIG. 8) by a temporary latching device, such as a friction strip 188.

Although the invention has been described with reference to certain exemplary arrangements, it is to be understood that the forms of the invention shown and described are to be treated as preferred embodiments. Various changes, substitutions and modifications can be realized without departing from the spirit and scope of the invention as defined by the appended claims.

What is claimed is:

1. A mailbox assembly for receiving and holding incoming mail and for allowing outgoing mail to be readily removed, the mailbox assembly comprising:

a mail storage module including a welded assembly of sheet metal panels enclosed within a masonry shell, the welded assembly enclosing a mail storage vault, one of the sheet metal panels having a mail drop port formed therein;

a collection panel disposed below the mail drop port for receiving deposited mail;

a slide panel extending transversely through the mail storage vault between the mail drop port and the collection panel for guiding deposited mail toward the collection panel;

a locking collection door coupled to the mail storage module for providing authorized access to the mail storage vault;

a mailbox receptacle mounted on the mail storage module and overlying the mail drop port, the mailbox receptacle including sidewalls and a pivot door that is movable between an open position and a closed position, the pivot door having a top panel portion and a trap door panel, the trap door panel being rotatable through the mail drop port and into the mail storage vault as the pivot door is moved to the closed position;

the mail storage module including a metal plate disposed adjacent the drop port and below the mailbox, receptacle the metal plate being positioned to allow the trap door panel of the pivot door to hang substantially in alignment with the metal plate when the pivot door is in the closed position and wherein the slide panel includes a shoulder portion joined to the metal plate and projecting transversely with respect thereto, thereby defining an offset pocket for receiving the trap door panel when the pivot door is in the closed position.

2. The mailbox assembly of claim 1, further comprising:

a latch strip attached to an interior portion of the mailbox receptacle, the latch strip being releasably engagable with the pivot door in the open position.

3. The mailbox of claim 1, further including a rotatable flag pivotably coupled to one of the sidewalls of the mailbox receptacle, the flag comprising a quadrant disc.

4. The mailbox of claim 1, wherein the metal plate comprises an exterior panel portion of the mail storage module.

5. The mailbox of claim 4, further including alphanumeric visual indicia formed on the exterior panel portion of the metal plate.

6. The mailbox of claim 4 wherein the mailbox receptacle further comprises an overhang portion that extends beyond the exterior of the mail storage module and beyond the pivot door in the closed positioned.

7. The mailbox of claim 1 wherein the metal plate and the trap door panel are sized and positioned to allow the trap door panel to form a flush engagement between them when the pivot door is in the closed position.

8. The mailbox assembly of claim 1, the mailbox receptacle including:

a receptacle frame;

the pivot door being rotatably coupled to an intermediate portion of the receptacle frame between the top panel portion and trap door panel, the trap door panel weighing more than the top panel portion, the pivot door being pivotable between an open position and a closed position;

the metal plate being positioned to allow the guide panel portion of the pivot door to be suspended in at least near flush engagement with the metal plate when the pivot door is in the closed position.

9. The mailbox assembly of claim 1, further comprising:

a disc flag rotatably coupled to a portion of the receptacle mailbox unit, the disc flag being rotatable between a substantially hidden, retracted position and an extended, visible position.

10. The mailbox assembly of claim 9 including: a receptacte frame and wherein a most-vertical portion of the disc flag is below the most-vertical portion of the receptacle frame when in the retracted and extended positions and any position in between.

* * * * *

UNITED STATES PATENT AND TRADEMARK OFFICE

CERTIFICATE OF CORRECTION

PATENT NO. : 6,244,505 B1
DATED : June 12, 2001
INVENTOR(S) : James W. Grimes and Rebecca Ann Grimes It is certified that error appears in the above-identified patent and that said Letters Patent is hereby corrected as shown below:

Column 6,
Line 35, after "mailbox" delete -- , --
Line 36, after "tacle" insert -- , --
Line 39, after "position" insert -- ; --

Signed and Sealed this

Sixteenth Day of April, 2002

*Attest:*

*Attesting Officer*

JAMES E. ROGAN
*Director of the United States Patent and Trademark Office*